US007229234B2

(12) United States Patent
Lim

(10) Patent No.: US 7,229,234 B2
(45) Date of Patent: Jun. 12, 2007

(54) METHOD FOR PREVENTING AND DISCHARGING FLOOD

(76) Inventor: Po Tung Lim, Flat F, 18th Floor, Butler Towers, Boyce Rd., Jardine's Lookout (HK)

( * ) Notice: Subject to any disclaimer, the term of this patent is extended or adjusted under 35 U.S.C. 154(b) by 0 days.

(21) Appl. No.: 10/550,815

(22) PCT Filed: Jun. 23, 2004

(86) PCT No.: PCT/CN2004/000674

§ 371 (c)(1),
(2), (4) Date: Sep. 23, 2005

(87) PCT Pub. No.: WO2005/003466

PCT Pub. Date: Jan. 13, 2005

(65) Prior Publication Data

US 2006/0193696 A1 Aug. 31, 2006

(30) Foreign Application Priority Data

Jul. 4, 2003 (CN) ..... 03 1 30361

(51) Int. Cl.
*E02B 7/20* (2006.01)

(52) U.S. Cl. ..... 405/87; 405/92; 405/107; 405/80

(58) Field of Classification Search ..... 405/87–107
See application file for complete search history.

(56) References Cited

U.S. PATENT DOCUMENTS 4,242,009 A * 12/1980 Minami ..... 405/93
4,299,514 A * 11/1981 Muramatsu et al. ..... 405/115
4,324,506 A * 4/1982 Steinke ..... 405/96
4,498,810 A * 2/1985 Muramatsu et al. ..... 405/115

FOREIGN PATENT DOCUMENTS

JP 10-204853 * 8/1998

* cited by examiner

*Primary Examiner*—Frederick L. Lagman
(74) *Attorney, Agent, or Firm*—Raymond Y. Chan; David and Raymond Patent Group

(57) ABSTRACT

This invention discloses a simple and convenient method of floods control and with great discharge capacity. This invention is a method of speeding up the river floods water discharge ability into the sea by means of the natural tidal range. This is done by the following technical proposals. To set up the PTCCG between the tidal current limit of the estuary and the coast tangent or narrower part of the estuary; the said PTCCG should be built across the river from the banks theoretically. When there is a danger of flood during the floods seasons, we can close the PTCCG and prevent the tidal current from entering into the inner river. When the tide ebbs, we can re-open the PTCCG and discharge the freshwater withheld into the sea. The PTCCG is normally open when it is not used. This invention is applicable to all tidal estuaries, which are affected by the astronomical tide range. It makes use of the natural tidal range to control floods in the upper stream of the river, which has a great floods control capacity, and accelerates the speed of floods discharging into the sea.

18 Claims, No Drawings

METHOD FOR PREVENTING AND DISCHARGING FLOOD

BACKGROUND OF THE PRESENT INVENTION

1. Field of Invention

This invention relates to the field of river floods control and management, more specifically, it is a method of controlling river flood by means of astronomical tidal current at the estuary (a river mouth open to the sea) to control and discharge floods in upper stream.

2. Description of Related Arts

Floods disaster has been very serious in China. According to the imperfect statistics, there were 1092 major floods during the 2,155 years between 206 B.C and 1949 A.D. i.e. once every two years in average. Countless lives and properties were lost. There is an old saying about the Yellow River "bursts twice every three years, changes of its course once every hundred years".

From the olden days, Chinese people combat hard with the serious floods, specially, from the foundation of the People's Republic of China. The Chinese government constructed many river conservancy projects. The new measures include both engineering and non-engineering approach. Gradually, a more comprehensive floods control system was founded. As a result, the Yellow River did not have great floods for the past 50 years and the Chinese people were proud of having no major flood problem for 50 years in the yellow river. This is indeed a great achievement in Chinese history. However, we should notice that China had still great difficulties in river flood control. The flood control standard is still not high enough. Whenever there is abnormal heavy rainfall, China is still facing dangerous situations, directly endangering embankments, reservoirs and other hydraulic projects etc. and will still cause catastrophe.

Rich experiences were gained during the long term floods fighting history in China, although nowadays new technology and new materials, enriches and improves the methods of dealing with floods. However, during the great floods at Yangtze River in the year of 1998, there are still more than 9,000 dangerous locations and incidents found on the river banks along the Yangtze River.

For case study, in the year 1999, heavy rainstorm occurred in the tributaries of the Yangtze River upper stream, such as Min River, Tuo River, Jiangling River, Wu River, and also occurred in the Yangtze River middle & lower stream, such as Dongting Lake and Boyang Lake.

As a result, serious floods happened in all sections of the Yangtze River, such as Xiang, Zi, Ruan, and Li in the Dongting Lake area and the Chang River, and Lean River in the Boyang Lake area and so on. Four crests developed at trunk stream of the Yangtze River upper stream consecutively.

The water level of most of the main hydrology station from Yichang to Nanjing along the trunk stream had risen beyond the caution level, among these figures, such as that recorded at the hydrology stations of Shashi, Shishou, Jianli, Lianhuatang, Luoshan, Wuxue, Jiujiang and ChengLingji of Dongting Lake and Hukou of Boyang Lake were approaching the highest historical record. The third highest water level happened at the hydrology stations of Hankou and Datong City. The fact that the flood level reached the record high in most segments of the Yangtze River reviews the fact that the flood conditions is deteriorating continually.

There were local rainstorms at the Yangtze River upper stream in the year of 1999, and floods water levels were reported to have been well above the caution level at Wu River and Min River. The floods at Wu River were very serious. The highest floods level 204.63 m which was 12.63 m higher than the safety pledged level (192.00 m), and 0.12 m higher than the historical highest level (204.51 m in 1955) which happened in June at Wulong (of Chongqing City). The corresponding flow rate recorded was 22,500 $m^3/s$, which was the largest flow rate ever recorded (the old historical largest flow rate was 21,000 $m^3/s$ in the year 1964).

Being affected by the tremendous amount of rainfall from Yangtze River upper stream, it was found that a historical biggest floods happened in July 1999 at the Cun Tan (near Chongqing) hydrology station at the trunk stream of Yangtze River upper stream with the floods peak of 180.02 m, which was 0.02 m higher than the caution level (180.00 m), and the corresponding water flow rate was 48,700 $m^3/s$.

Four floods crest were recorded at the hydrology station of Yichang, with the flood peak levels reaching 51.38 m, 52.20 m, 53.68 m, and 51.73 m, and the corresponding flow rate were 46,800, 51,800, 57,200 and 44,200 $m^3/s$ respectively. All of these crests were still considered to be ordinary flooding in Yangtze.

Having been affected by the great amount of water from the Yangtze River upper stream and the two major lakes and other branches, the trunk stream water level of Yangtze River middle and lower stream began to rise after mid-June. The water level at the hydrology stations at Shishou and Wuhu was the first to rise beyond the caution level.

The water levels of different river segments from Jianli to Liauhuatang and from Jiujiang to Datong have also risen beyond the caution levels gradually in different stages afterwards, and the important segments from Lianhuatang to Hankou had also reached the caution level.

The highest water level occurred at most of the main hydrology stations along the Yangtze River after mid-July, 1999. The peak water level of 44.74 m at the hydrology station of Shashi in July was the second highest record ever, which was 1.74 m higher than the caution water level (43.00 m), although lower than the historic record of the year of 1998 (45.22 m). The highest water level in July at the Jianli hydrology station was 38.30 m, which was 1.02 m higher than the pledged water level (37.28 m), and was only 0.01 m lower than the historical highest water level (38.31 m in 1998).

The highest water level in July at the Lianhuatang hydrology station was 35.54 m, which was 1.14 m higher than the pledged water level (34.40 m), and was the second highest water level, of actual record in 1998 (35.8 m) . The highest water level in July at Luoshuan hydrology station was 34.60 m, which was 0.59 m higher than the pledged water level (34.01 m), and it was the second highest water level of actual surveying record in 1998 (34.95 m).

The highest water level in July at the Hankou hydrology station was 28.89 m, which was 1.59 m higher than the caution water level and it was the third highest water level (29.73 m in 1954, and 29.43 m in 1998). The highest water level in July at the Jiujiang hydrology station was 22.43 m, which was 2.93 m higher than the caution water level (19.50 m) and it was the second highest water level recorded in 1998 (23.03 m). The highest water level in July at Datong hydrology station was 15.87 m, which was 1.37 m higher than the caution water level (14.50 m).

At present, the overall standard for preventing floods is still not very high. If there are some floods which are concentrated and are developed within a very short period, dangerous flood situations and disasters will be formed. These will bring great lost to the country and the people. If there is a comparatively simple and efficient method to discharge the floods, it will be beneficial to the country and the people and the people in the future generations inside.

SUMMARY OF THE PRESENT INVENTION

Owing to the more and more frequent human activities which brought about the lost of surface soil, diminishment of lakes and the change of climate, floods will became more and more serious. The present floods preventing measures cannot deal with some serious floods. The purpose of this invention is to supplement the insufficient flood control measures and to provide an easy to construct, user friendly method with a greater water discharge ability to combat floods.

This invention is a method to speed up the rate of floods flowing into the sea by utilizing the property of the tidal current through the following method. By constructing a Programmable Tidal Current Control Gate (PTCCG), the previous name of which is "Tide Sluice Gate", was changed in order to avoid any confusion with "storm surge barrier" which has exactly the same in Chinese name, anywhere within the tidal current limit of an estuary (coast tangent or any narrow part at the estuary); the PTCCG should be built across the river theoretically.

Whenever there are dangers of floods, the PTCCG should be closed at high tide to stop the seawater from entering the inner river. At low tide, the PTCCG is re-opened and the floods water collected and withheld will be discharged into the sea. The PTCCG is normally open when not in use and is thus environmentally friendly.

The PTCCG can be built at the narrower part of the estuary. The PTCCG can be made up by different kinds of gates, for example, rolling gate, or multi-section flat sluice gate. The multi-section flat sluice gate will be used in the following examples.

In order to achieve the function of floods prevention, it is, unnecessary to cover the full span of the river mouth with PTCCG. It would be sufficient to build only 20%~80% of the narrower part of the river in the case of Yangtze River. Even when there is a danger of serious flood, the PTCCG will only be used for about 7~14 days. The number of days of using the PTCCG depends on the span of the PTCCG and the amount of rainfall.

The advantage of this invention is that, by utilizing the natural and readily available tidal current at the estuary to prevent flooding is a low running cost method, and with very great capacity to control floods and with high speed of discharge of flood water into the sea.

Take Yangtze River as an example to show the great advantage of this invention. The following is the quantitative analysis of the flood preventive effect of PTCCG. The flood control capability of the PTCCG can be determined by the volume of tidal current that is excluded from entering the river by the new PTCCG mechanism.

1. Method I: By the Volume of Tidal Current Excluded from Statistics

According to the relevant records, between 1958 and 1988, there were records of a total number of 62 tides (including spring, middle, neap tide and no floods tide). The total tidal current volume was 118.05 billion $m^3$ and each tide was 1.904 billions $m^3$ . Of those tides records, there were four tides, each had a tidal current volume 1.99 billions $m^3$. It shows that the average tidal current was about 2 billions $m^3$, including spring tide, neap tide, flood tide and no flood tides. (Note: If there is the latest tidal current information the impact of the greenhouse effect and the rise of sea-level on rivers floods can be reckoned.)

2. Method II: By circumscription and calculating the physical volume occupied by the tidal current at the estuary according to the data of factual average tide range.

If the PTCCG is established at Hengsha Island, the average tidal range is 2.67 m. Assuming at the time of the average tidal range, the water level increase at the tidal current limit—Jianyin to be 0 m, and we assume the water level increase is linearly proportional to the distance along the river. This is a rough circumscription and reckoning. There must be quite a big difference, because there are phase differences when the tide waves were transferred to each section and this has not been taken into account.

The width of the estuary at Nangang is 7 km, Qiyakou is 9 km, Xuliujing is 5 km, and Jiangyin is 2 km, while it is 180 km from Hengsha Island to Jiangyin. If we calculate the volume of the river segment by segment, the total volume of tidal current region which is affected by the PTCCG is around 2 billion cubic meters.

Inferred from both of the above reckoning and estimations, we can conclude that at each tide (average tidal range) at the mouth of Yangtze River, the river bed can withhold and discharge 2 billion $m^3$ more floods water by using this invention and this is equivalent to 44,000 $m^3/s$.

These and other objectives, features, and advantages of the present invention will become apparent from the following detailed description, the accompanying drawings, and the appended claims.

DETAILED DESCRIPTION OF THE PREFERRED EMBODIMENT

The following is the further description of how to carry out the invention with examples.

To construct the PTCCG at the estuary: The PTCCG can be set up at the front most edge of the estuary, i.e. on coast tangent, or down to the narrower part of the river mouth. Of course, much bigger Floods Receiving Lake will be created if the PTCCG is set up at the front most edge of the estuary. However, after constructing the PTCCG, when we compare the flood with the discharge capability, the scale of flooding would be relatively much smaller than before.

So if it is chosen that the PTCCG is to be built at coast tangent, it would only increase the cost and will not benefit much more when dealing with floods. That is the floods discharge ability will be too much if the PTCCG is set up at the coast tangent. That is "breaking a fly on the wheel". It would be advisable to set up the PTCCG at the narrower part of the estuary, so as to reduce the construction cost, or at any other suitable place between the estuary and tidal current limit, for instance, taking into account of the requirement of transportation and the need of roads building.

By setting up PTCCG at the estuary, it can stop the tidal current (together with river water) from flowing backwards into the inner river. When a flood occurs at the middle stream of Yangtze River, we can close the PTCCG before high tide, and the tidal current cannot enter the inner part of the river.

The original space occupied by the sea water is emptied out and will be transformed into an enormous size empty "Floods Receiving Lake", which can withhold and discharge a lot of water from the middle stream of the Yangtze.

When the tide ebbs, and since the water level in the Floods-Receiving Lake is higher than the sea level, tremendous amount of floods water will be discharged into the sea.

This is just like an exchange station running and operating continuously without any stop, the same can be re-used every 12 hour and 25 minutes. This will resolve most of the over-flooding problems at low gradient plains and river delta areas. This is a more effective system to prevent flooding than most existing flood control systems.

The design requirement of the PTCCG will be relatively simple if the only function is used to stop the tidal current from entering the inner river. If there is no atrocious weather, then it is only necessary to build the PTCCG at a height which is enough to prevent the tidal current from entering the inner river at high tide.

In order to achieve this target, it is only necessary to get the hydrology record of the highest tide level and/or the highest runoff water level at the estuary, and build the PTCCG a little higher than the above two levels to stop the tidal current. In fact, the requirement to construct the PTCCG for stopping tidal current from entering into the inner river is not enough, because the PTCCG is set up at the river mouth area. It has to face with atrocious sea weather, especially at Yangtze River mouth and Rhine river mouth etc, where storm surge occurs very frequently.

So the factor of durability of PTCCG should not be ignored, therefore, the design standard should be much higher than that for stopping tidal current only. It should be designed and constructed in such a way that it can resist salt, wave and storm in the long run and can stand against atrocious stormy environment.

The choice of the PTCCG could be rolling gate (like the one in Thames River) or multi-section flat sluice gate (like the one in River Rhine). The following example assumes to use a multi-section flat sluice gate, each section of the PTCCG is about 20 meters wide. If the river mouth is 680 meters wide, then 34 PTCCG sections should be built. Since the total span of all the PTCCG is the summation of all the width of PTCCG sections built, the total number of PTCCG sections to be built when the necessary span of the PTCCG is decided.

Our target is to stop the tidal current at the location of PTCCG, the artificial tidal current limit, even when we encounters with the biggest tidal current. It is still unnecessary to build 100% full span of PTCCG at the narrower part of the river. The PTCCG is also unnecessary to conform to the coast tangent so as to get the biggest floods prevention capability.

After the set up of PTCCG, the water flow from the middle and lower stream of the Yangtze River will become relatively small because of the high discharge efficiency of the PTCCG. It is unnecessary to construct the PTCCG conforming to the coast tangent in order to solve the floods problems in the middle and lower stream of the Yangtze River.

As a result, the construction cost will become our main concern. Take the Yangtze River as an example. If we have decided to set up the PTCCG at the narrower part of the estuary, using the average tide range as the basis of reckoning, it can discharge the "50 billion cubic meters excess flood" by operating PTCCG for 13 days. The figure 50 billion cubic meters was the true record of excessive floods water in Middle and Lower Stream of the Yangtze River as announced by the water authority.

If we choose to build the PTCCG at the coast tangent, the same volume can be discharged by reducing the operating day to 3~5 days. In fact, reducing 8 days is of minimal consequence during the floods seasons. Since we have more and more scientific rain forecast, we can operate the PTCCG in advance and to control and keep the water at a lower level in Wuhan and Hunan Province. Setting up the PTCCG at the coast tangent will increase the span of the PTCCG and the construction cost. In order to reduce the discharge time from 13 days to 5 days, if we need to use much more resources and money (in the order of 10 billion Chinese Yuan) to achieve this, then this is quite uneconomical and unnecessary.

Because the volume of the tidal current entering the estuary is directly proportional to the cross-sectional area of the upper layer of water at the river mouth (since the thickness of tidal current is more or less the same along the PTCCG, the volume of the tidal current is also directly proportional to the width of the river mouth), when the width of the river mouth is temporary and gradually reduced by closing some sections of the PTCCG, the volume of tidal current entering the river mouth is also reduced.

In order to evaluate the best and critical numbers of sections of the PTCCG to be built, it is only necessary to calculate what the percentage width of river mouth that should be blocked is, so as to achieve the target of keeping the tidal current to a standstill. Once we conclude that the width of the river bed to be reduced so that the tidal current cannot surpass the PTCCG, we can define this width to be the best (economically speaking) span of the PTCCG to control flood, (or we can call this "the best critical span".

Best critical span=width at the narrower part of the river mouth−the width of the river mouth that the PTCCG is not required; or Best critical span=the width at the narrow part of the river mouth−(the biggest rate of flow of runoff during the flood seasons/the rate of flow of tidal current per unit width). For example, during the floods seasons, the runoff flow rate was 10,000 $m^3/s$, whereas the tidal current flow rate was 40,000 $m^3/s$, and the width of the river is 2,000 m, then the unit capacity for the tidal current flow is 40,000/2000=20 $m^3/s/m$.

Then the total portion of width that there is no demand to build PTCCG is equal to 10,000/20=500 m. Suppose the original width of the narrower part at the river mouth is 100 m, if we need to reduce the width temporary by 500 m, so that the rate of flow of runoff will be equal and opposite to the rate of flow of tidal current. Based on the above reckoning, we can conclude that the best critical span of the PTCCG is: 1100 m−500 m =600 m.

Assuming that the PTCCG is to be built at the coast tangent of the Yangtze River mouth, and that the average tidal difference of 2.67 m, the rate of tidal current entering the inner river is 266,300 $m^3/s$. At spring tide is about 400,000 $m^3/s$, and at neap tide is about 140,000 $m^3/s$. The record of the highest runoff flow rate of Yangtze River was 93200 $m^3/s$.

In order to keep the tidal current limit during the flood seasons to be at the position of PTCCG without surpassing the PTCCG, we shall use the PTCCG to trim down the width of river mouth and only leaving the width which can allow the capacity of 93,200 $m^3/s$ tidal current to enter the river, then at this critical moment, the momentum of the runoff and the momentum of the remaining portion of tidal current will be equal and opposite, and the tidal current will be kept standstill.

If we want to reduce the tidal current entering capacity from 400,000 $m^3/s$ to 93,200 $m^3/s$, the mouth of the Yangtze River should be temporary reduced by: (400,000−93,200)/400,000, which is equal to 76.7%.

In other words, to achieve target of the tidal current to be standstill at the location of PTCCG, we can spare 23.3% of the coast tangent without setting up the PTCCG. Assuming that the PTCCG is set up at some narrower part of the Yangtze River mouth, as Yangtze River mouth is cornet shaped, the difference of width between the narrow part and the coast tangent of the river is very great, if we select a narrower part of a river mouth with its width of 40% of that at the coast tangent, then we only need to build 40%–23.3%=16.7% of the coast tangent width. This 16.7% is the best critical span.

The tide and tidal current has its own cycle and it is not the same every day. The flooding time of tide occupies only a small portion of the tide cycle and flood tide occupies only several days in a lunar month. Therefore, the chance to utilize the maximum number of sections of the PTCCGs only happens in several hours in several days in each lunar month.

Furthermore, during the days of flood tide, the quantity of tidal current entering into the river mouth increases gradually and slowly, and the period of biggest tidal current takes place only up to a few hours and it is only a small portion of the high tide cycle. Therefore the time taken to utilize all the PTCCGs would not be long. For example, the biggest tidal current in each tide only happens in 2.5 hours, which is ⅕ of each tidal period of 12 hours and 25 minutes.

Therefore, it would be uneconomical if we build too many sections of PTCCGs to improve this very short period of time by only a little. As the floods control capability of PTCCG is very great. Even if the PTCCG is built a litter shorter, with fewer sections, it will only increase the application duration of the PTCCG by a little. Nowadays, we have more and more advanced technology.

If we can obtain more exact rain forecast in the upper and middle stream of the river, then we can start to utilize the PTCCG one or two days ahead of the arrival of crest. It is not necessary to spend too much money on setting up a full range "perfect span" of PTCCG, which will be beyond the actual need.

In order to achieve some or incomplete floods control results, we only need to build several sections of PTCCG across the two banks of the river. However, if the numbers of PTCCG sections to be built are too small, for example, only three or four sections are built, we cannot ensure that the greater floods can be discharged within a short period of time when there is a really heavy rainstorm at the middle or upper stream of a river.

This effect is just like to have taken insufficient dosage of medicine when we are sick. If the numbers of PTCCG to be built is not enough, it ends up with the ability to combat weaker floods which happened once every 10 years, but not those severe floods, which can bring about disasters e.g. those happened once every 100 years or 1000 years.

In order to build PTCCG lesser than required, we may use the PTCCG in advance, but if we are enforced to use PTCCG too early or very often in advance, there are also some disadvantages. For example, when there are a lot of rainfall at the middle and upper stream in the earlier days of the rainy season, but suddenly the weather becomes dry, this will produce an extremely low water storage level and is often a waste of the fresh water resources, when we operate PTCCG too often in advance and discharge the floods too early.

The PTCCG must not be used too often since it has a big flood discharge capacity. The PTCCG can only be used for several times and then stopped during the floods seasons, otherwise, the river water will be over-discharged. If the rainfall becomes very small after the rainy days, it will create low water level even at the rear part of the same floods seasons, not benefiting the sailing of ships.

Take the Yangtze River as an example, the PTCCG can increase the volume of discharge by about 2 billions cubic meters per tide, or 3.8 billion cubic meters per day (because there is 1.93 tides in each Solar day), while the excessive flood during the big flooding in 1954 (which was once 100 years) is only 50 billion cubic meters, (according to the data from the Chinese water authority), then it is only necessary to use the PTCCG for 13 days to overcome the flood disaster. If we utilize the PTCCG for more than 13 days, the river and lake water level might begin to get low.

The Principle of Operation of PTCCG (The Creation of the "WHITE HOLE":

The prime objective of constructing PTCCG is to stop tidal current from flowing into the inner river. Before the tidal current enters the watercourse of the inner river, we should start closing the PTCCG. The flow of the tidal current will be stopped by the PTCCG temporarily at the river mouth and cannot flow into the inner river. In other words, the tidal current limit has been temporary blocked up at the position of PTCCG, and the location of the PTCCG becomes the temporary tidal current limit at this particular moment.

When the PTCCG is built and operated at the Yangtze River mouth, an empty space is created within the estuary, let us call this Flood Receiving Lake, the Flood Receiving Lake has recurrent floods absorbing and discharge power. This special function can be repeated every 12 hours and 25 minutes. The tidal current is prohibited to enter into the estuary. The original salt wedge in the estuary brought about by the tidal current is emptied out and changed into a hollow space, which we can call it "White Hole".

The said White Hole has a low elevation of about ±5 meters from the sea level, far below the floods level on the plain, so it is able to absorb the nearby flood continually as well as discharging the water from the White Hole into the sea at low tide. We call it White Hole so as to distinguish it from "Black Hole" in astronomy.

The Black Hole can only absorb things inwards and nothing can come out, whereas in the case of White Hole, it not only can absorb water into its body without a definite limitation, since the water can be discharged out into the sea. The White Hole has a big water absorbing power, its performance is just like the drinking action of the human being, one mouthful after the other. PTCCG can drink another gigantic mouth after 12 and half hours elapsed, until it's satisfied and close the throat.

By the reckoning with different methods, the floods preventive capability of White Hole Flood Receiving Lake is 2 billion cubic meters in average for each tide (12.4 hours), and 3.8 billion cubic meters for each solar day in the case of Yangtze River.

The huge magnitude and capability of flood control and the impulsion all originates from the potential energy difference of the tide and the kinetic energy of the tidal current. If we evaluate the energy withheld by the PTCCG in each and every tide, according to the potential energy difference of the volume of water kept in the Flood Receiving Lake, it is about $1.12\times10^{14}$ Joule (J).

This potential energy withheld is used to push the floods water into the sea. It is equivalent to the summation of the energy consumption by using 3500 sets of 375 KW hydraulic pumps (assume 100% efficiency) to pump the river water into the sea 24 hours a day.

Very big space between the river segment of the old and new tidal current limit of the river is no longer filled up by seawater and is left empty. The capacity of the empty space to absorb the flood water from upper stream becomes much greater than the natural situation. The White Hole is not just like the shape of the salt wedge in the estuary, but like a long floor carpet of several meters thick forming a very big and empty temporary lake, we can call it "White Hole Flood Receiving Lake."

The river flowing into the area between the old and new tidal current limit is just like flowing into a lake. Whereas the physical behavior of a lake is totally different from that of the complex estuary, i.e. the natural flow pattern has been temporary and completely modified. The water level in the White Hole Flood Receiving Lake is higher than the sea at low tide, and the water thereof withheld will be discharged into the sea and another cycle will start again.

The PTCCG has the ability to prevent and control floods because it can change the complex hydrodynamic conditions of the estuary temporarily and completely. There are many factors affecting the hydrodynamic conditions at the estuary and the mutual relationship among them is very complex. Each of the said hydrodynamic condition is by itself changing all the time. These conditions are constantly, continuously and mutually affecting, re-grouping and re-adjusting with each other and producing different resultant combination effect in the estuary.

These complicated hydrodynamic factors include, the runoff which varies greatly between floods and no-flood seasons, tide of two cycles each day, spring and neap tides of two cycles each month, sand content which varies greatly in each year, numerous storm and storm surge, ceaseless waves, shape of the estuary, and the cross-sectional area of the river bed etc. and the resultant of the complicated combinations and effects produced by these conditions happening simultaneously. When studying the estuary problems, we should not only pay attention to the effect of each individual condition, but also the combining effects produced by several conditions happening at the same time.

Of these very complex "parameters", there are two factors which can be modified by human beings (with engineering measures), that is the shape of estuary and the cross sectional area of river bed. Permanent change of shape of estuary is usually not advisable, but the PTCCG can change the cross-sectional area of the riverbed at any time temporarily as desired by mankind.

It provides a secured measure to control the hydrodynamic conditions in the inner estuary when necessary. It creates a great empty space to receive the flood in the watercourse itself. It conserves and provides the energy source for the increase of flow of flood, so it will become the best measure to control flood and the management of the estuary.

The PTCCG is a very flexible institution, which can be used to modify the width of the outlet of Yangtze River estuary temporarily, mainly at the high astronomical tide in order to keep the Yangtze estuary at the ideal cross-sectional area at all times and create the ideal effect at the estuary in order to combat flood. This is a strong and powerful, easy to operate, flexible, durable and effective institution to control floods.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of floods control and flood discharge comprising the steps of:

(a) setting up a programmable tidal current control gate (PTCCG) at an estuary of a river, wherein said PTCCG, which is built across a river, is selectively controlled between a closed position and an opened position;

(b) providing a floods receiving lake;

(c) closing said PTCCG when there is a danger of floods in flood seasons for preventing a tidal current from entering into an inner portion of said river;

(d) guiding flood water to said floods receiving lake when said PTCCG is closed;

(e) re-opening said PTCCG for discharging said flood water into the sea; and (f) keeping said PTCCG opened when it is not in use.

2. The method, as recited in claim 1, wherein said PTCCG is constructed at a narrower portion of said estuary.

3. The method, as recited in claim 1, wherein said PTCCG is constructed at a coast tangent of a river mouth.

4. The method, as recited in claim 1, wherein said PTCCG is fabricated of multi-sectional flat sluice gate.

5. The method, as recited in claim 2, wherein said PTCCG is fabricated of multi-sectional flat sluice gate.

6. The method, as recited in claim 3, wherein said PTCCG is fabricated of multi-sectional flat sluice gate.

7. The method, as recited in claim 2, wherein a span covered by said PTCCG is between 20% and 30% of a width of said narrower portion of said estuary.

8. The method, as recited in claim 5, wherein a span covered by said PTCCG is between 20% and 30% of a width of said narrower portion of said estuary.

9. The method, as recited in claim 1, wherein during a flood season, said PTCCG is used for a period of 7 days to 14 days.

10. The method, as recited in claim 6, wherein during a flood season, said PTCCG is used for a period of 7 days to 14 days.

11. The method, as recited in claim 8, wherein during a flood season, said PTCCG is used for a period of 7 days to 14 days.

12. The method, as recited in claim 1, wherein when the water level in said floods receiving lake is higher than the sea level, said flood water is discharged into the sea.

13. The method, as recited in claim 2, wherein when the water level in said floods receiving lake is higher than the sea level, said flood water is discharged into the sea.

14. The method, as recited in claim 3, wherein when the water level in said floods receiving lake is higher than the sea level, said flood water is discharged into the sea.

15. The method, as recited in claim 7, wherein when the water level in said floods receiving lake is higher than the sea level, said flood water is discharged into the sea.

16. The method, as recited in claim 8, wherein when the water level in said floods receiving lake is higher than the sea level, said flood water is discharged into the sea.

17. The method, as recited in claim 10, wherein when the water level in said floods receiving lake is higher than the sea level, said flood water is discharged into the sea.

18. The method, as recited in claim 11, wherein when the water level in said floods receiving lake is higher than the sea level, said flood water is discharged into the sea.

* * * * *